US007143717B2

(12) United States Patent
Murphy

(10) Patent No.: US 7,143,717 B2
(45) Date of Patent: Dec. 5, 2006

(54) COVER ATTACHMENT SYSTEM

(76) Inventor: Mark J. Murphy, 2631 Lansdowne, Waterford, MI (US) 48329

( * ) Notice: Subject to any disclaimer, the term of this patent is extended or adjusted under 35 U.S.C. 154(b) by 0 days.

(21) Appl. No.: 11/259,647

(22) Filed: Oct. 26, 2005

(65) Prior Publication Data

US 2006/0086306 A1 Apr. 27, 2006

Related U.S. Application Data

(60) Provisional application No. 60/720,407, filed on Sep. 26, 2005, provisional application No. 60/623,092, filed on Oct. 27, 2004.

(51) Int. Cl.
*B63B 17/00* (2006.01)

(52) U.S. Cl. ..... 114/361; 114/219

(58) Field of Classification Search ..... 114/219, 114/343, 361, 364; 135/88.01, 119; 410/102, 410/104, 106

See application file for complete search history.

(56) References Cited

U.S. PATENT DOCUMENTS 3,065,724 A * 11/1962 Tritt ..... 114/219
4,292,913 A * 10/1981 Siebert et al. ..... 114/219
5,215,032 A * 6/1993 Ellis et al. ..... 114/361
5,367,977 A * 11/1994 Ellis et al. ..... 114/361
5,396,861 A * 3/1995 Acker et al. ..... 114/361
5,730,077 A * 3/1998 Nunes et al. ..... 114/219
5,829,378 A * 11/1998 Nunes et al. ..... 114/219
5,839,388 A * 11/1998 Vadney ..... 114/361
6,349,662 B1 * 2/2002 Limansky et al. ..... 114/219
6,659,035 B1 * 12/2003 Treytiak ..... 114/361
6,863,009 B1 * 3/2005 Driver ..... 114/219
6,886,489 B1 * 5/2005 Zarn et al. ..... 114/361

* cited by examiner

*Primary Examiner*—Lars A. Olson
(74) *Attorney, Agent, or Firm*—John R. Benefiel

(57) ABSTRACT

An attachment system for a boat cover using an insert strip press fit in a conventional rub rail channel fixed to the boat hull. The insert strip has a lengthwise slot which is configured to mate with a series of retainer elements attached about the perimeter of the cover. Each retainer element has a portion configured to be received in the insert strip slot and locked thereto by being turned sideways. In one embodiment, the retainers have a flattened pin which can be pushed into the insert strip slot and turned, a larger head portion thereby fit to a larger interior section of the slot to be locked therein. In another embodiment the retainer elements each have a pair of spread projections which are compressed together to be able to be pushed in through the slot entry section and which spring apart in the interior slot section, to be locked therein. A threaded pin can be advanced between the projections to produce a positive spreading of the projections. Racks and battens can also be attached to the insert strip using the same retainer elements.

18 Claims, 11 Drawing Sheets

FIG - 3
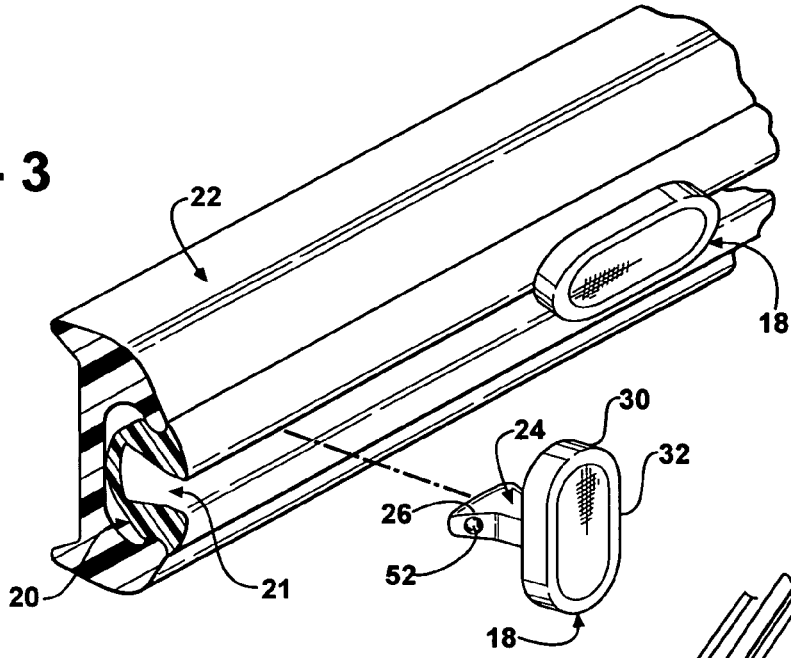
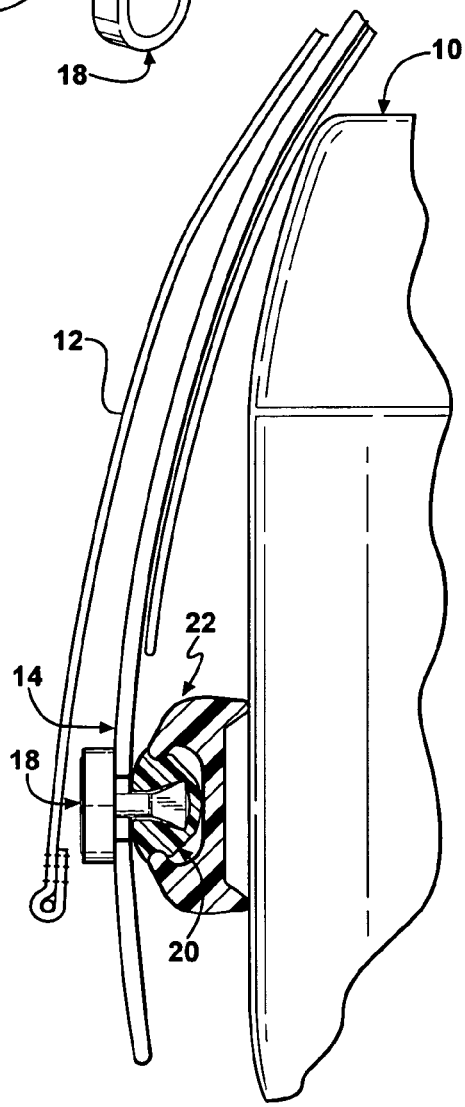
FIG - 5

COVER ATTACHMENT SYSTEM

CROSS REFERENCE TO RELATED PATENT APPLICATIONS

This application claims the benefit of U.S. Provisional Applications No. 60/623,092 filed on Oct. 27, 2004 and No. 60/720,407 filed on Sep. 26, 2005.

BACKGROUND OF THE INVENTION

This invention concerns attachment of flexible covers for boats and the like. Flexible or soft covers are conventionally attached by a series of mating snaps attached to the cover and the boat respectively. The snaps are time consuming to install as they require drilling holes in the fiberglass boat hull, and entail excessive maintenance items as they typically fail at a high rate, particularly under high loads as when ice and snow accumulate on the cover. Also, the shrinkage or stretching of the cover may make installation and removal of the cover difficult since the mating snaps become misaligned.

Another attachment method involves using a line threaded along the cover hem extending around the perimeter of the cover which is tightened to secure the cover on the boat. This usually results in loose areas of the cover and may not be secure enough to trailer the boat with the cover on.

U.S. Pat. No. 4,292,913 describes use of a hook feature formed on a boat rub rail channel used to mate with cover fastenings. This approach requires a special form of the channel to replace the standard rail configuration. Also, the hook connection is not as secure as mating snaps.

Rub rail channels most typically are of extruded plastic or aluminum and receive a soft rubber or plastic bumper insert or a length of rope used to cushion impacts.

It is the object of the present invention to provide a flexible covering attachment system which utilizes a standard or preexisting rub rail channel, and does not require holes to be drilled in the hull nor accurate alignment of snaps or other attaching elements on the hull with mating elements on the cover.

It is a further object of the present invention to provide a durable and strong cover attachment system which does not require frequent replacement of parts and which is easy to install and use, and is not affected by the cover stretching or shrinking, yet is secure enough to allow the cover to remain in place during trailering of the boat.

SUMMARY OF THE INVENTION

The above recited objects and other objects which will be understood upon a reading of the following specification and claims are achieved by an attachment system including a special insert press fit installed into a conventional rub rail channel which may already be installed the boat hull. The insert strip is a plastic extrusion formed with a central longitudinally extending slot having a narrow entry section opening into a wider interior section. A series of retainer elements are sewn or otherwise attached to the cover around the perimeter which are able to be releasably mated with the insert strip slot to secure the cover to the boat. The retainer elements may be shaped as with a flattened pin portion with an enlarged head projecting from a base grip portion able to be grasped by the fingers to enable manual turning of the retainer element. The pin head is flat to be able to be inserted into the slot when turned but will engage with the insert strip slot when turned vertically within the slot. Thus, the retainer elements are able to be inserted into the slot when turned sideways, and captured when turned back to a vertical orientation to secure the cover to the rub rail channel by locking engagement of the retainer elements therewith.

The slotted insert has a pair of shallow recesses, one on each side, which capture inwardly facing channel rail lips to secure the same to the channel. A curved bottom of the insert engages the rub rail channel bottom wall when installed, tending to spread the insert strip sides defining the central slot into firm engagement with the rub rail channel side walls.

The retainer elements can be mounted to the cover in several ways, i.e., sewn directly to the cover hem, attached to a separate strap extension sewn to the cover, above the hem or with the pin portion of each retainer element captured in a respective one of a series of grommets sewn into the perimeter of the cover.

In an alternative embodiment, the retainer element has a pair of side by side spaced apart projections extending from a bendable double wing piece. The projections have wedge shaped tips which when pushed into the insert strip slot are forced together to be able to pass through the entrance section and into the wider interior section of the slot, the tips springing apart thereafter. Bending of the wings allows removal of the retainer element by causing the projection tips to be brought together. In a variation of this embodiment, a threaded pin is advanced into a threaded hole in the center of the retainer element between the projections to positively force the projection tips apart and thereby more positively hold the retainer element in the slot.

In another embodiment, a toggle member connected to a strap sewn to the cover is pivoted on each of the retainer elements and when flipped down tightens the cover by an over center action.

The attachment system can be employed to mount battens and racks for skis or wake boards, by retainer elements passed through openings in the rack or batten. Similarly, cover bows can be mounted to the hull by a retainer element pivoted on each end of the bow.

DESCRIPTION OF THE DRAWINGS

FIG. 3 is a pictorial view of a fragmentary section of the rub rail channel and slotted insert strip with a partially exploded view of a retainer element according to the present invention.

FIG. 5 is an end view of a retainer element installed in an insert strip shown in section and capturing a batten received in a cover batten pocket, shown in fragmentary form.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
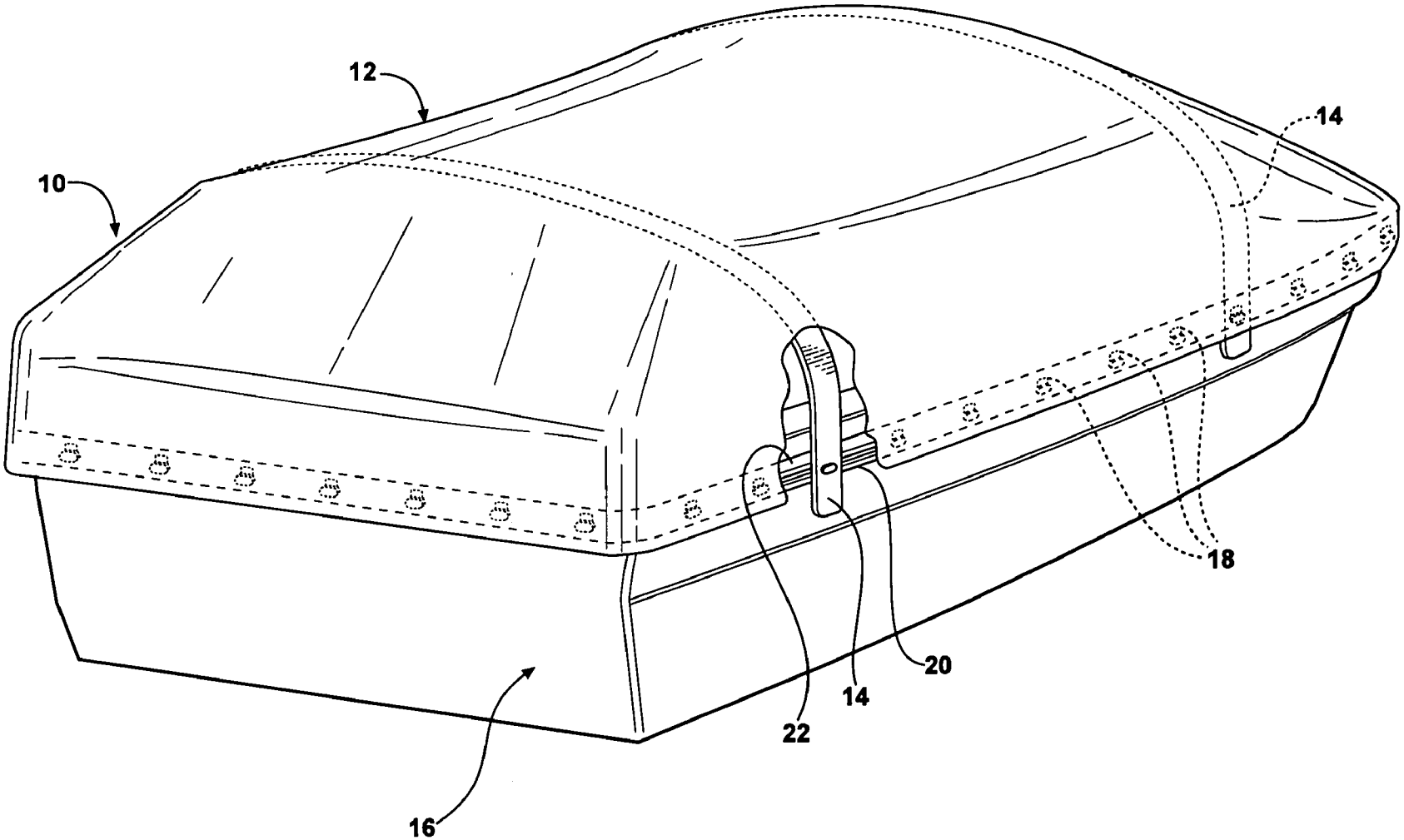
FIG. 1 is a pictorial view of a boat having a mounted cover and buttons installed thereon using the attachment system according to the present invention.

Referring to the drawings, and particularly FIG. 1, a boat 10 is shown having a cover 12 installed thereon with a pair of battens 14 supporting the cover 12 above the beam of the boat.

Figure 2:
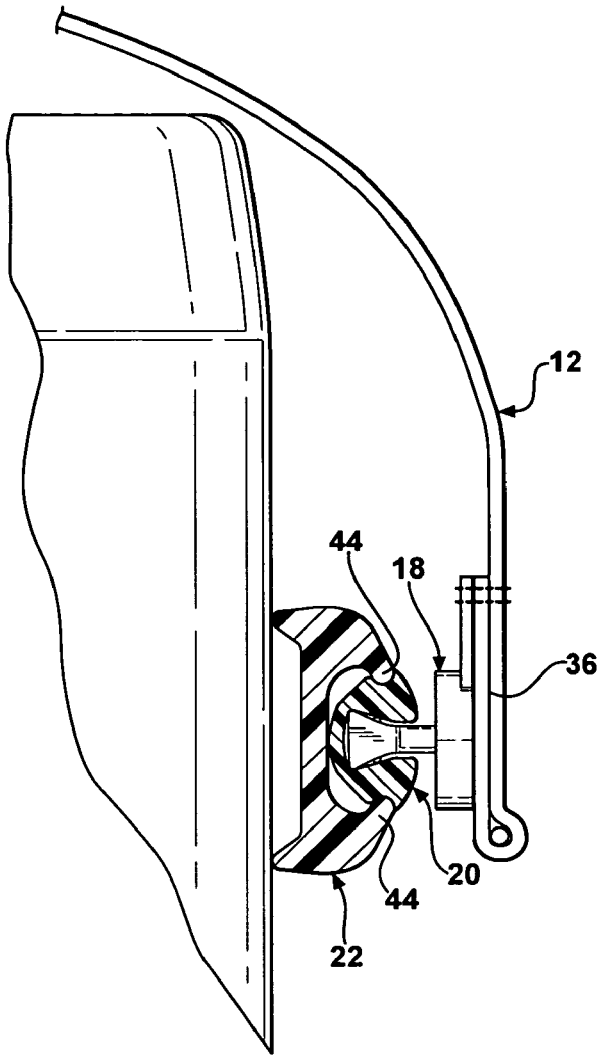
FIG. 2 is an enlarged partially sectional view of attachment system components associated with the boat hull and cover shown in fragmentary form.
Figure 2A:
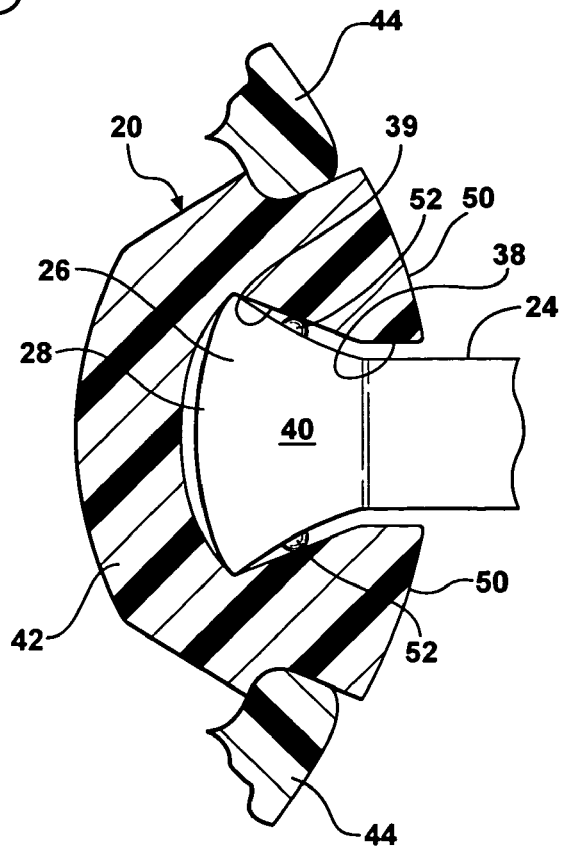
FIG. 2A is an enlarged sectional view of the insert strip and a retainer element installed therein in the locked position.

The cover 12 is secured to the boat hull 16 by a cover attachment system according to the present invention including a series of retainer elements 18 attached along the inside of the perimeter of the cover 12 and locked to a slotted insert strip 20 press fit into a conventional rub rail channel 22 fixed to the hull and extending around the complete perimeter thereof. FIGS. 2 and 3 show the details of the retainer elements 18 and insert strip 20.

Referring to FIGS. 2 and 3, the retainer elements 18 are constructed of a molded hard plastic such as nylon and include a flattened pin 24 having a head portion 26 which has an enlarged contour in the plane of the flattening, with a curved end 28.

A grip portion 30 is integrally molded with the pin 24 and is somewhat elongated to be shaped like a short rounded end bar to be able to be easily gripped with the thumb and fingers to enable manual turning of the pin 24 to install or remove the same from a central slot 21 formed in the insert strip, as described below.

An integral short tab 32 projecting from the top of the grip portion 30 is sewn or otherwise attached to the inside of the hem 36 of the cover 12 to be completely concealed beneath the cover 12.

The insert strip 20 is made from a molded plastic such as RPVC to be capable of acting as a protective bumper able to withstand impacts, and also stiff enough to be capable of securely connecting to the retainer elements 18 to hold the cover 12 in place stretched over the boat 10.

A narrow entry section 38 of the slot 21 allows the pin 24 to be inserted therein with the flat sides 40 of the pin 24 turned horizontally. The flat sides 40 are chamfered at the curved end 28 to facilitate insertion into entry slot section 38.

The entry slot section 38 diverges to form a wider, angled side interior slot section 39 which has a curved bottom wall 42 shaped to be complementary to the curved end face 28 of the pin 24.

The exterior of bottom wall 42 is also curved out. This causes the side walls of the insert strip 20 to be moved out when seated in the rub rail channel 20.

This increases the tightness of engagement of channel lips 44 with rounded pockets 46 molded into the sides of the insert strip 20.

Sloping sides 48 on the insert strip 20 aid in installation into the rub rail channel 20.

The exposed outer surfaces 50 of the insert strip 20 are curved to absorb impacts in acting as a bumper strip. The pin head portion 26 is enlarged in the generally plane of its flattening but sized slightly smaller than the slot interior section 39 to create clearances allowing it to be rotated after insertion to be locked in position in the slot 21.

The head portion 26 is formed with a molded protrusion 52 on each side which tighten up the clearances to reduce looseness in the fit between the head portion 26 and slot interior section 3*a* and insure that the head portion 26 does not twist back to a vertical orientation when being slid along the insert strip 20. A snap fit can thus be felt when the retainer element 18 is turned to its locked position, allowing installation in darkness. The ability to slide easily along the insert strip 20 makes it easier to put the cover 12 on as the retainer elements 18 can find their proper location by such sliding movement after being locked in the insert 20 allowing the cover position to be freely shifted before all of the retainer elements 18 are installed.

Figure 2B:
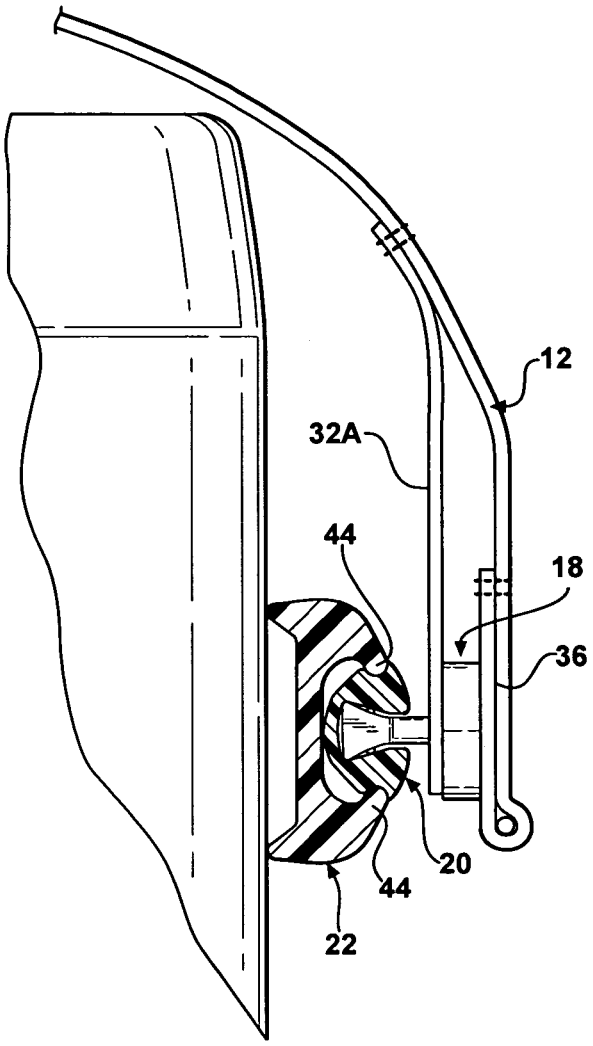
FIG. 2B is a partially sectional view of an alternate attachment of the retainer element to the inside of the cover.

FIG. 2B shows that a separate strap 32A may be used to hold the retainer element 1B, strap 32A extending up to a higher point where it is sewn or otherwise attached to the inside of the cover 12. This allows the retainer element 18 to be turned without the need to twist the cover material to make installation and removal easier.

Figure 4:
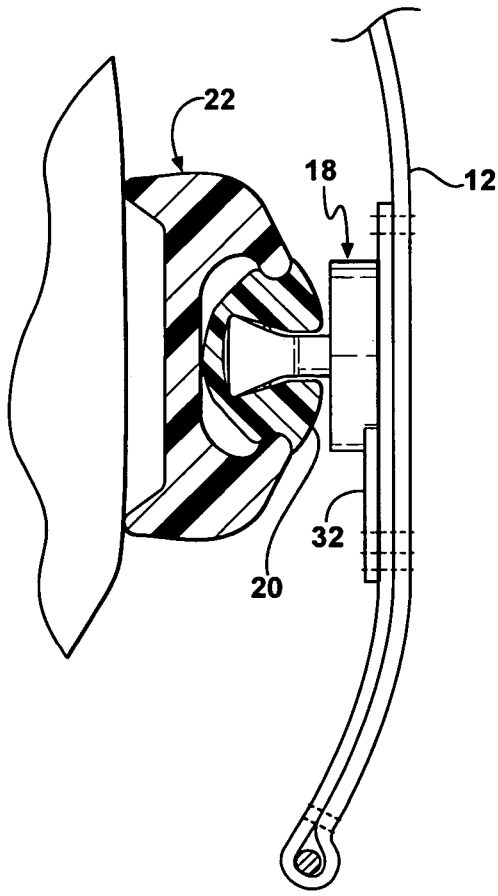
FIG. 4 is an end view of a retainer element attached to a cover by an alternative method and installed in a slotted insert strip and rub rail channel shown in sections.

FIG. 4 shows an alternative attachment for the retainer element 18, in which the tab 32 is oriented downwardly and is sewn to the cover 16 as shown.

In the attachments of FIGS. 2 and 4, the rotation of the retainer element 18 to install the same necessitates localized gathering of the cover 12, while that of FIG. 2B avoids that.

FIG. 5 shows mounting of the batten 14 by a retainer element 18 which is rotatably captured on the lower end of the batten 14 by being assembled in the hole in the batten 14. The retainer elements 18 can be of two piece construction as in the threaded connection shown in FIG. 11, for such use, or can be forced through the hole in the batten 14.

Figure 6:
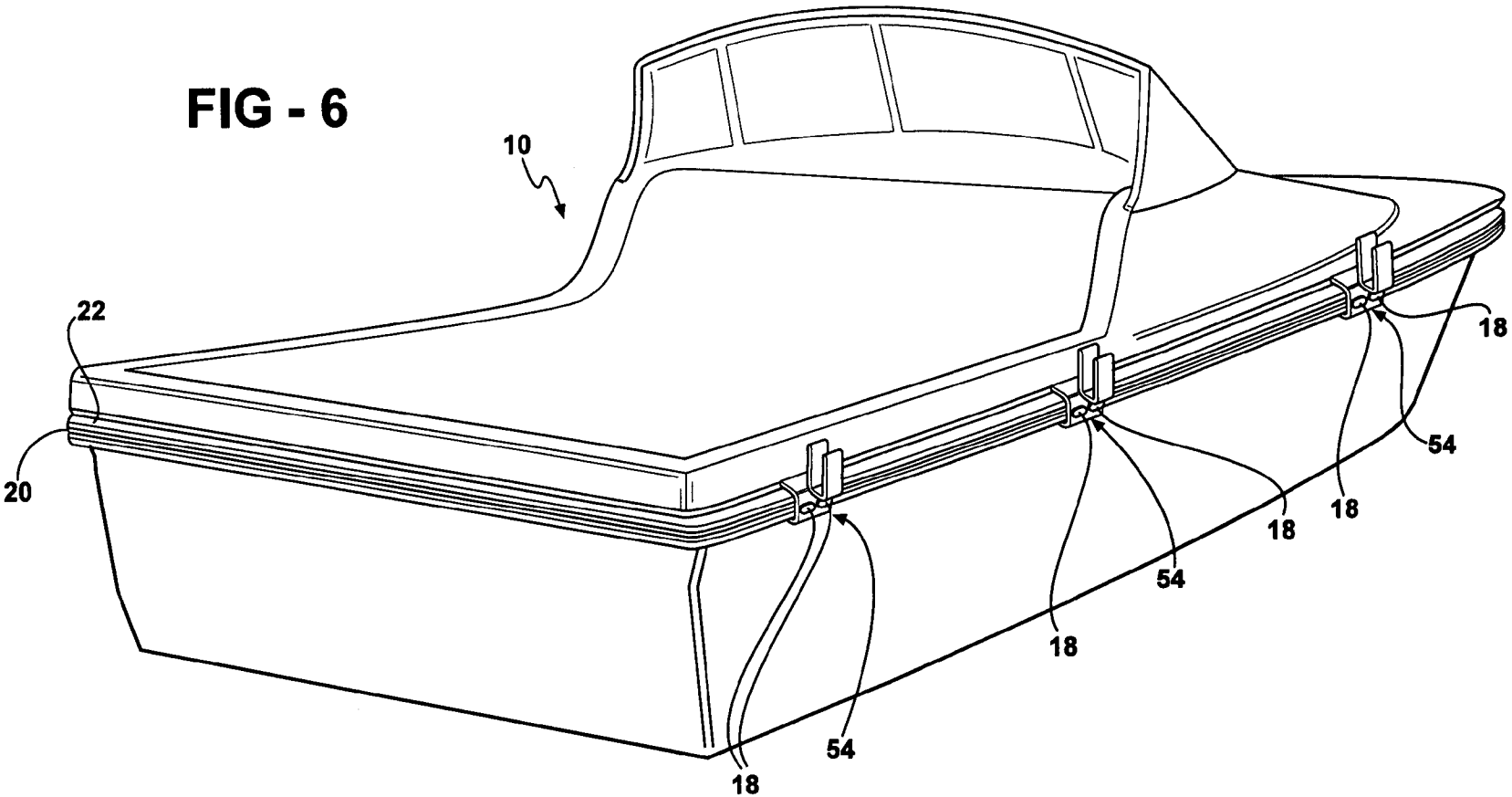
FIG. 6 is a pictorial view of a boat having ski racks mounted thereto using the same attachment system used for the cover as shown in FIGS. 1–5.
Figure 7:
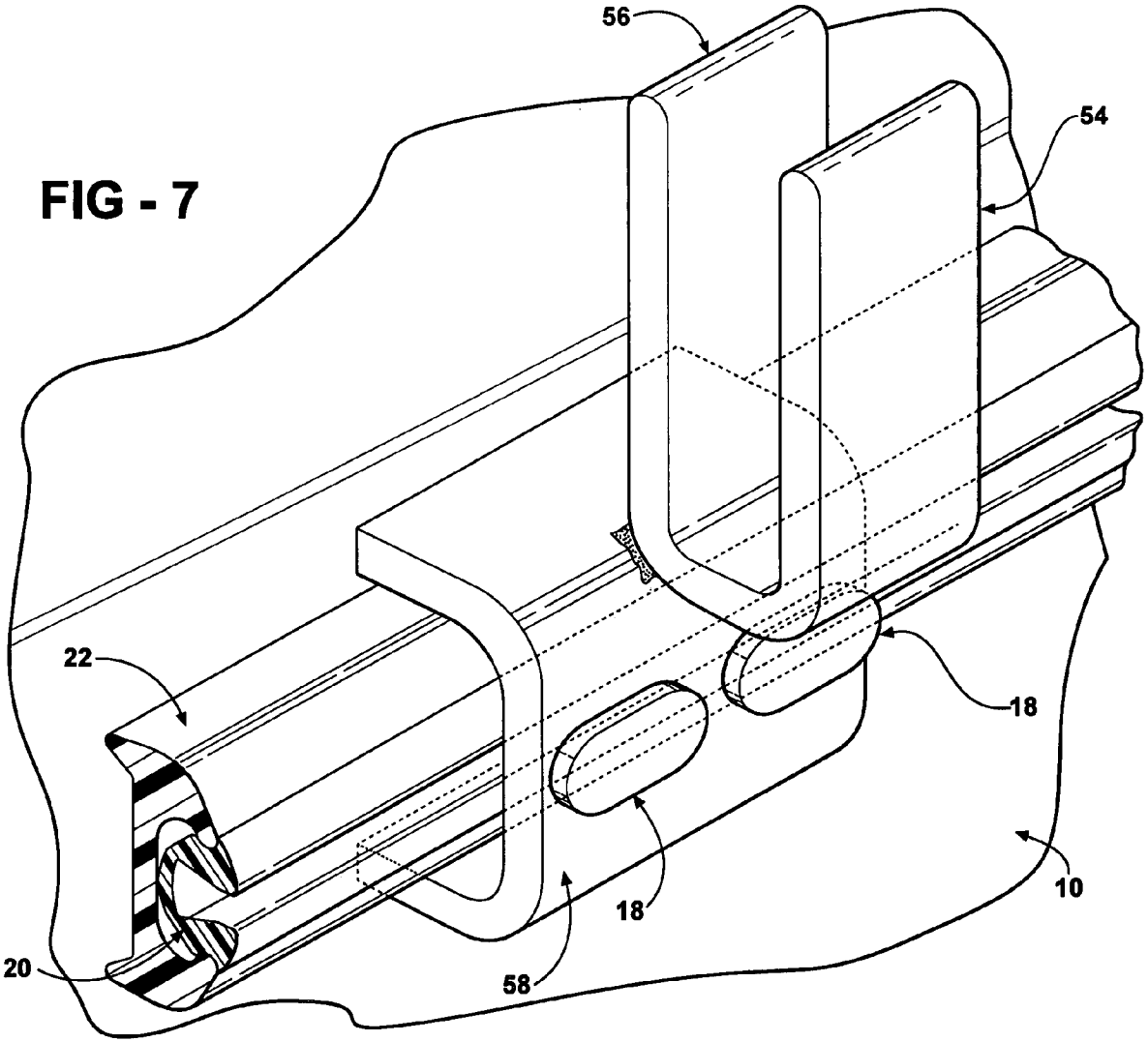
FIG. 7 is an enlarged fragmentary pictorial view of a portion of the boat showing one of the racks shown in FIG. 6.

As shown in FIG. 6, skis or other elongated gear may be stowed on racks 54 which may also be removably mounted to a boat 10 by a similar attachment system. The racks 54 include a fork member 56 created by a pair of spaced apart upright members connected to each other at their lower ends. The fork member 56 is integral with a horizontally facing U-shaped member 58 received over the rub rail channel 22.

A pair of retainer elements 18 are shown rotatably captured on the U-shaped member 58, with the pin portions 24 projecting inwardly to be received in the insert strip 20 as described above.

The fork member 56 is located on the outboard side of the U-shaped member 58 to allow the cover 12 (not shown) to pass around the same when in place on the boat 10.

Figure 8:
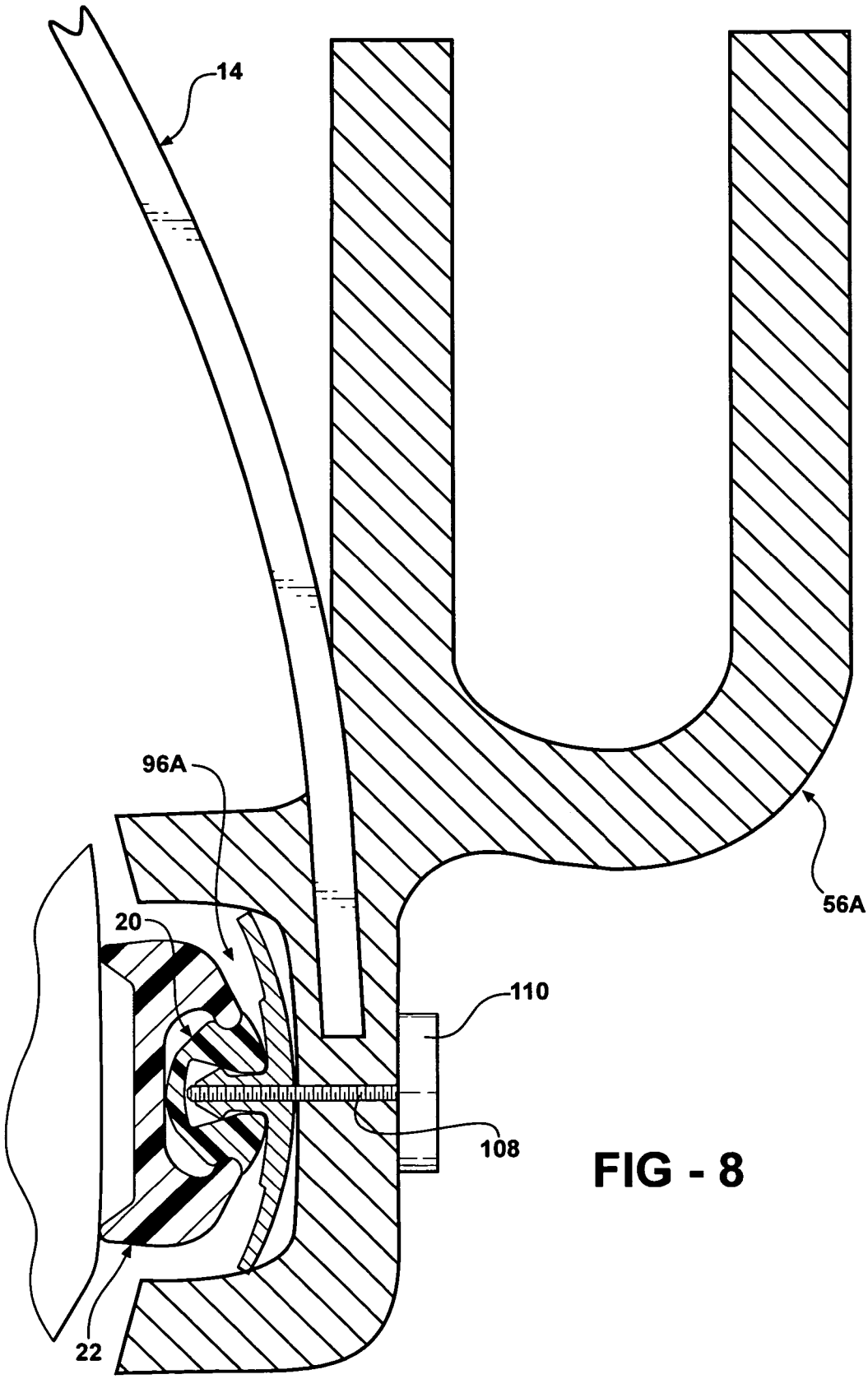
FIG. 8 is a sectional view of a modified form of the mounted rack shown in FIG. 7.
Figure 14:
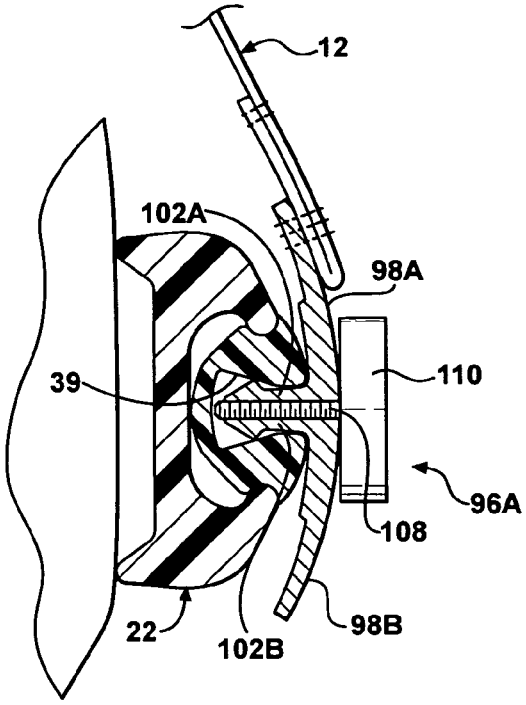
FIG. 14 is a sectional view of the retainer element as shown in FIG. 13 with a thread locking pin installed in a threaded hole in the retainer element.

Another form of the rack 56A (FIG. 8) features a batten recess 60 allowing battens 14 to be conveniently mounted thereto by being inserted in the recess 60. In this version, the retainer elements 96A described below in connection with FIG. 14 are used to insure that the rack 56 does not shift along the rail 22. The functioning of the retainer element 96A is described below.

FIGS. 9A, 9B, 10A, and 10B show an alternate form of the retainer element 64 mating with the slot 21 in the insert strip 20. This embodiment features an over center toggle 66 pivotally mounted to the head of a pin 68 by a metal cross pin 70. The pin 68 has an enlarged head portion 72 designed to lock to the slot in the insert strip 20 in similar fashion to the embodiment described above.

The cover 12 has a strap hemmed at 76 to a cover loop 74.

Figure 9B:
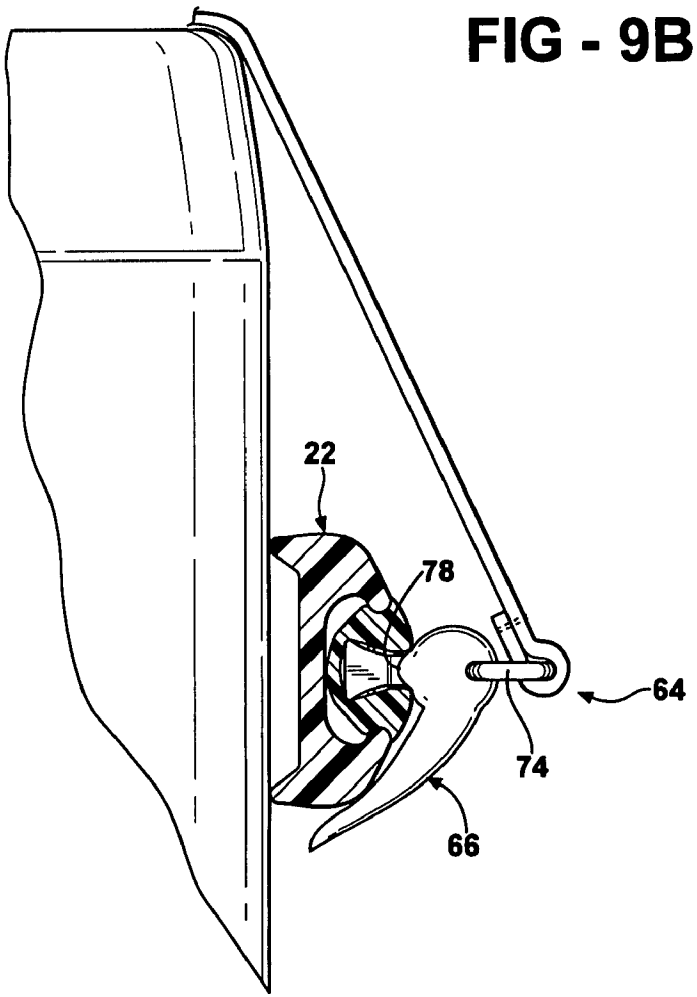
FIGS. 9A and 9B are side views of another form of retainer element shown installed in an insert strip shown in section and in the released and locked condition respectively.
Figure 9A:
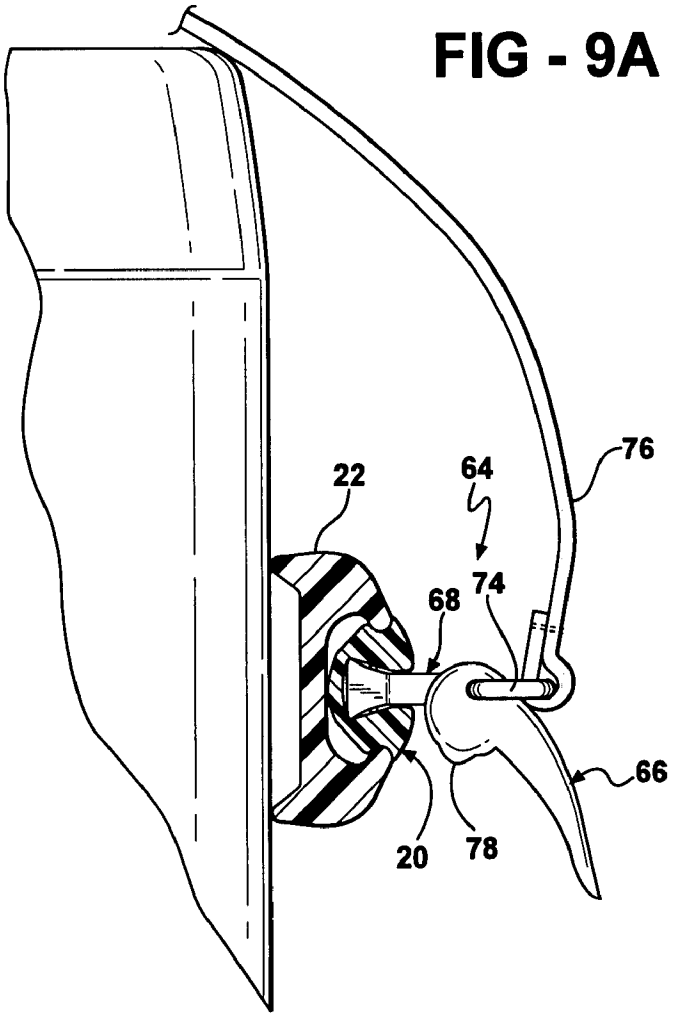
Figure 10A:
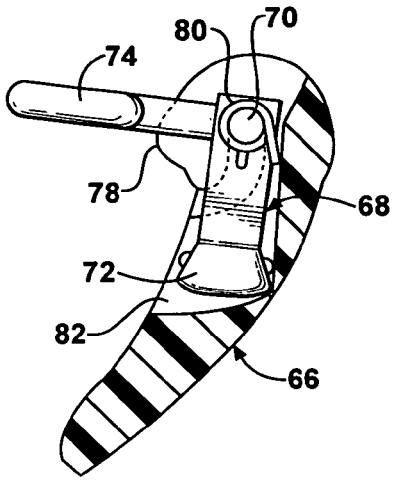
FIGS. 10A and 10B are enlarged sectional views of the retainer element shown in FIGS. 9A and 9B.
Figure 10B:
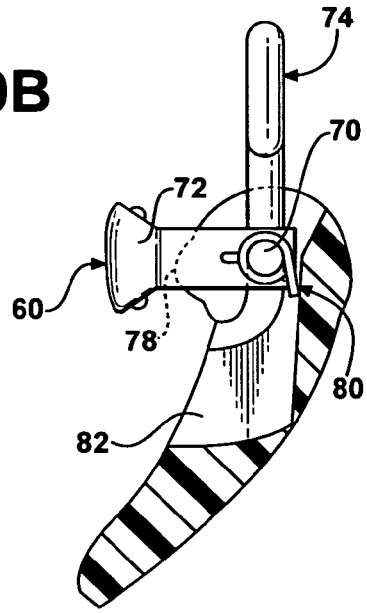

The toggle 66 pivot has off center with respect to the connection to the strap loop 74 so that when flipped down against the insert strip 20 as seen in FIG. 9B, the strap loop 74 is pulled down to tighten the cover 16. A protuberance 78 rotates into the slot entry section 38 to provide a detent holding the toggle 66 in that position.

A bias spring 80 may be provided to urge the pin 68 into a recess 82 in the inside of the toggle 66.

Figure 11:
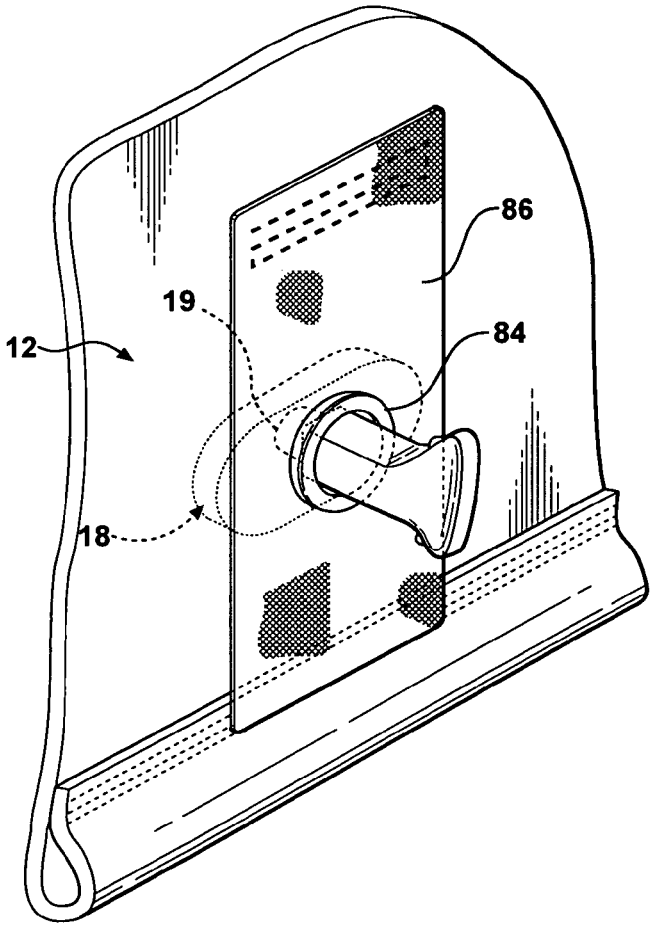
FIG. 11 is a pictorial view of a retainer element mounted to a boat cover in an alternative way, the cover shown in fragmentary form.

Referring to FIG. 11, an exposed mounting for the retainer elements 18 is shown. A grommet 84 is mounted to the cover 16 with a reinforcement patch 86 captured by the grommet 84. A two piece construction of the retainer elements 18 may allow assembly in the grommet 84 utilizing a threaded stem 17 to connect the pin 24 to the grip portion 30 while the pin 24 is in the grommet 84 to capture the same. The retainer element 18 is rotatable in the grommet 84 to allow the pin 24 to be locked in the slot 21 of the insert 20 as described above.

Figure 12:
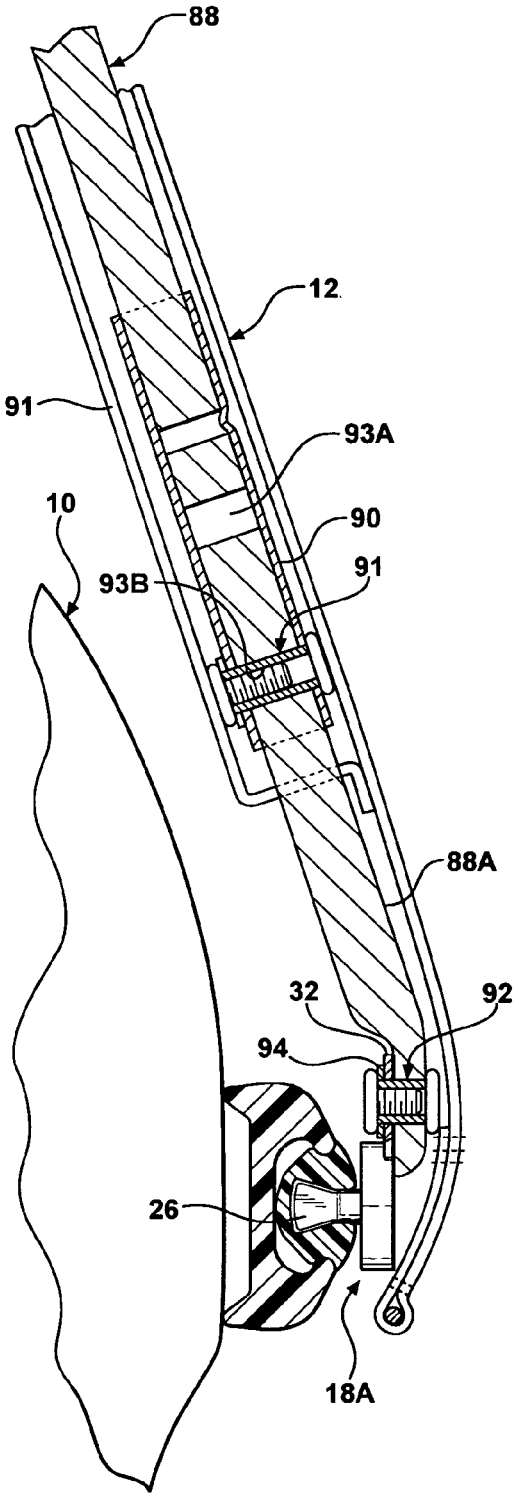
FIG. 12 is a side view in partial section of a retainer element as used to mount a cover support bow to an insert strip and rub rail channel shown in section.
Figure 12A:
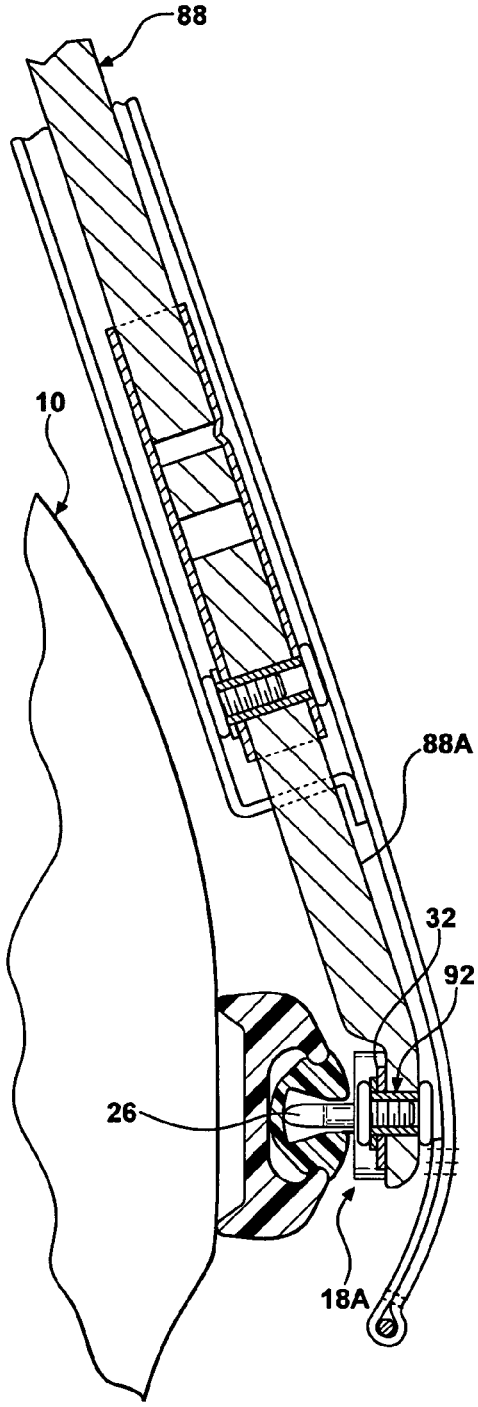
FIG. 12A is the view of the components of FIG. 12 with the retainer pivoted to a release position.

FIG. 12, 12A show the mounting of a cover support bow 88 by a retainer element 18A. The adjacent ends of the bow 88 and bow extension 88A as received in an extension socket 90. The socket 90 is connected to the bow extension 88A with a two piece threaded pin 91 in either hole 93A, 93B for length adjustment. The tab 32 is pivotally mounted to the bow end by a two part axle pin 92 screwed together, with a washer 94 facilitating rotation of the retainer element 18A. The pivoting allowed by the axle pin 92 enables locking and release of the pin head portion 26 in the slotted insert strip 20 as seen in FIG. 12A. The bow 88 and extension 88A are received in a cover pocket 91.

Figure 13:
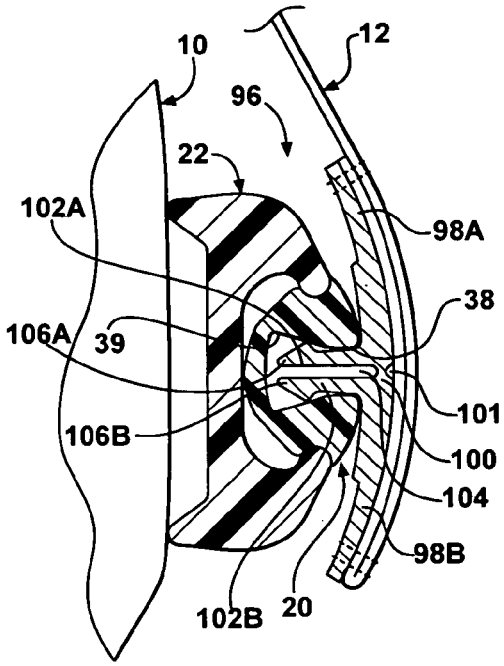
FIG. 13 is a sectional view of an alternative snap on embodiment of a retainer element installed in a insert strip shown in section.

An alternate embodiment retainer element 96 is shown in FIG. 13, which is configured to allow a simple push on, snap action installation. The retainer element 96 includes double curved wing portions 98A, 98B movable relative each other by an integrally connected thinner bridging portion 100 formed by a shallow groove 101 to allow resilient flexing of the two wing portions 98A, 98B relative to each other.

Each wing portion 98A, 98B includes an integral inwardly projecting rib 102A, 102B separated by a slot 104. A wedge shaped tip 106A, 106B is formed on each rib 102A, 102B.

The wedge shape of the tips 106A, 106B cause the projecting ribs 102A, 102B to be cammed together when pushed into the slot entry section 38 to be able to pass into the wider section slot 39, where the tips 106A, 106B again separate to hold the retainer element 96 therein.

To remove each retainer element 96, the wing portion 98A, 98B is sewn or otherwise attached to the inside of the cover 16.

The wing portions 98A, 98B are bent in to compress the tips 106A, B together allowing them to be pulled out to be released.

This embodiment still allows longitudinal sliding along in the slotted insert strip 20 to simplify the task of putting the cover 12 on a boat 10 since the cover 12 position can be shifted as needed.

In order to enhance the resistance to pull out of the retainer element 96, a modified form of the retainer element 96A includes a separate threaded pin 108 projecting from a grip 110 which can be advanced in a threaded hole in the center of the bridging portion 100.

With the threaded stem 108 in place, the retainer elements 96A are held tightly and cannot be slid along the length of the insert strip 20 after installation. These retainer elements 96A can advantageously be used at points across the stern of the boat 10 after other types of retainer elements 18, or 96 are used along forward parts of the cover 16.

Figure 15:
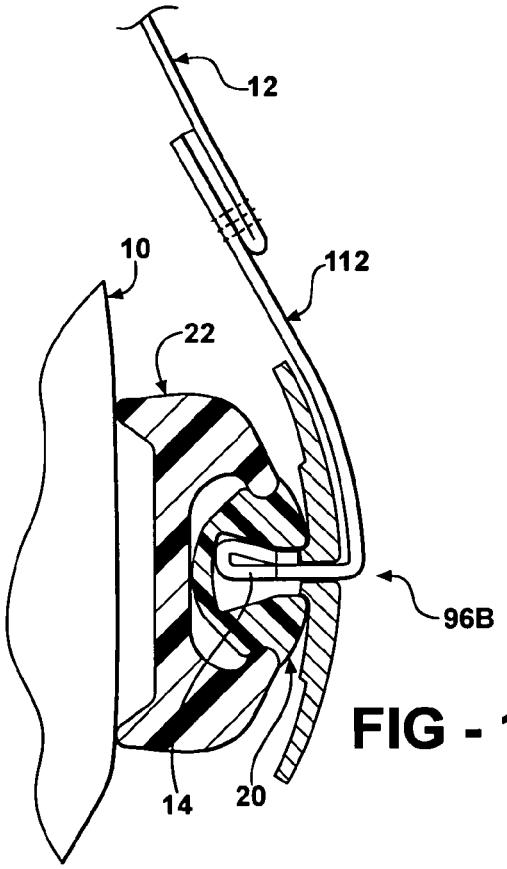
FIG. 15 is a sectional view of the snap on embodiment of the retainer element modified to have an extension strap mounted thereto shown installed.
Figure 15A:
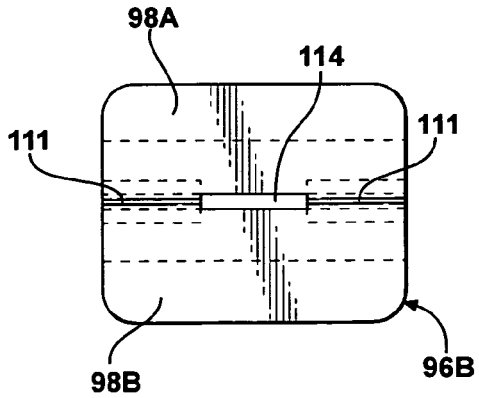
FIG. 15A is a front view of the retainer element shown in FIG. 15.

FIGS. 15 and 15A show the use of an extension strap 112 with another version of the snap fit retainer element 96B. A through slot 114 is formed in the center of the retainer element 96B of a width able to accommodate the strap 112 which is inserted and the end 114 doubled over and sewn to capture the lower end of the strap 112 therein. The upper end of the strap 112 is sewn to the hem of the cover 16.

Many variations are possible in the shapes and dimensions of the components of the attachment system, as will be appreciated by those skilled in this art.

For example, the headed pin portions can have ridges mating with grooves in the insert slot walls to improve retention.

An existing rub rail channel can be employed, able to receive the insert strip 20 according to the present invention.

The insert strip 20 can receive the retainer elements at any point along the slot to not require alignment of discrete elements while providing a secure, but easy, mating attachment of the cover 16.

The invention claimed is:

1. A attachment system for a cover for a boat having a rub rail base channel attached to a perimeter of its hull, comprising:

an insert strip press fit into and extending along said rub rail channel;

said insert strip being formed with a slot along the length thereof, said slot having a narrower entry portion and a wider interior portion;

a series of retainer elements connected to said cover at spaced locations along a perimeter of said cover, said retainer elements each having a projecting portion insertable through said entry section of said insert strip portion of said insert slot and thereafter reoriented to present an increased wider width to said slot entrance portion to be retained in said interior section of said insert strip slot whereby said cover is connected to said boat hull at spaced locations along said cover perimeter.

2. The system according to claim 1 wherein said projecting portion of each of said retainer elements comprises a pin having a wider head portion which is flattened and configured to be able to be inserted through said entry section of said insert strip slot when rotated to present said flattened shape parallel to said slot and when thereafter rotated to a substantially transverse orientation to said slot is retained in said wider interior section of said slot by said wider head portion.

3. The system according to claim 2 wherein each of said retainer elements is attached to said cover by a toggle member, said toggle member pivotally mounted to said pin and connected to said cover at an eccentric location to pull said cover down upon pivoting of said toggle member.

4. The system according to claim 2 wherein said pin is fixed to project from a grip portion of each retainer element to project therefrom graspable to enable turning of said pin head portion in said insert strip slot.

5. The system according to claim 4 wherein said grip portion of each of said retainer elements has a tab connected to said cover.

6. The system according to claim 5 wherein said tab of each retainer element is sewn to said cover.

7. The system according to claim 5 wherein said tab of each retainer element is sewn to one end of a respective one of a plurality of extension straps connected at an opposite end to said cover.

8. The system according to claim 5 wherein each retainer element is captured in a respective one of a series of grommets attached along the perimeter of said cover, said retainer element rotatable therein.

9. The system according to claim 1 wherein each of said retainer elements is formed with separate side by side spaced apart projections each connected to a respective one of oppositely extending wing portions connected together with a bendable bridging portion.

10. The system according to claim 9 wherein each of said retainer elements further include a threaded pin projecting from a grip portion and received in a hole in said bridging portion located so that when said pin is rotated it advances between said projections to positively spread apart said projections.

11. The system according to claim 9 wherein each of said projection tips are each wedge shaped and spaced so as to be pressed together when inserted in said entry portion of said insert strip slot.

12. The system according to claim 1 wherein said insert strip has a curved bottom wall engaging a bottom wall of said rub rail channel, and when pushed there against, and spreading apart sides defining said insert strip slot.

13. The system according to claim 12 wherein said rub rail channel has inwardly extending lips defining said channel and each lip is received in a pocket recess on a respective side of said insert strip.

14. The claim according to claim 13 wherein said insert strip slot interior section has sloping sides and a pin head portion has corresponding opposite sloping sides said pin head portion sloping sides each having a protrusion engaging a respective one said slot sloping sides.

15. The system according to claim 12 wherein a pin head portion has a curved end surface matched to said curved bottom of said insert strip slot.

16. The system according to claim 1 further including a batten in a pocket of said cover having a protruding end having a hole receiving a retainer element engageable with said insert slot.

17. The system according to claim 1 further including a rack having an upright fork member and an attached channel portion received over said rub rail channel with a retainer element captured in a hole in a bottom wall of said rack channel portion with a retainer pin portion head engageable with said insert strip slot.

18. The system according to claim 1 wherein said insert strip and retaining elements are made of molded plastic.

* * * * *